US009745674B2

(12) United States Patent
Hines et al.

(10) Patent No.: US 9,745,674 B2
(45) Date of Patent: Aug. 29, 2017

(54) FIBER BLENDS FOR WASH DURABLE THERMAL AND COMFORT PROPERTIES

(71) Applicant: DRIFIRE, LLC, Columbus, GA (US)

(72) Inventors: Robert Winfred Hines, Columbus, GA (US); James Jonathan Bailey, Fortson, GA (US)

(73) Assignee: DRIFIRE, LLC, Columbus, GA (US)

( * ) Notice: Subject to any disclaimer, the term of this patent is extended or adjusted under 35 U.S.C. 154(b) by 0 days.

(21) Appl. No.: 14/417,726

(22) PCT Filed: Jun. 28, 2013

(86) PCT No.: PCT/US2013/048521

§ 371 (c)(1),
(2) Date: Jan. 27, 2015

(87) PCT Pub. No.: WO2014/018221

PCT Pub. Date: Jan. 30, 2014

(65) Prior Publication Data

US 2015/0191856 A1 Jul. 9, 2015

Related U.S. Application Data

(60) Provisional application No. 61/676,518, filed on Jul. 27, 2012.

(51) Int. Cl.
*D02G 3/28* (2006.01)
*D02G 3/44* (2006.01)
(Continued)

(52) U.S. Cl.
CPC ..... *D02G 3/28* (2013.01); *D02G 3/045* (2013.01); *D02G 3/047* (2013.01); *D02G 3/32* (2013.01);
(Continued)

(58) Field of Classification Search
CPC ..... D02G 3/047; D02G 3/443; D02G 3/02; D02G 3/449; A41D 31/0022; A41D 1/00;
(Continued)

(56) References Cited

U.S. PATENT DOCUMENTS 3,803,453 A 4/1974 Hull ..... 361/220
4,035,441 A 7/1977 Endo et al. ..... 525/444
(Continued)

FOREIGN PATENT DOCUMENTS

AU 2015224518 6/2015
EP 0875620 A1 11/1998
(Continued)

OTHER PUBLICATIONS

International Preliminary Report on Patentability issued Nov. 5, 2014 for International Patent Application No. PCT/US2013/048521, Which was filed Jun. 27, 2013 and published as WO 2014/018221 on Oct. 10, 2013 (Inventor—Robert W. Hines ; Applicant—Drifire, LLC; (20 pages).
(Continued)

*Primary Examiner* — Scott R Walshon
(74) *Attorney, Agent, or Firm* — Ballard Spahr LLP

(57) ABSTRACT

Spun yarns, fabrics, and garments with a balance of high thermal and comfort properties are disclosed. Spun yarns made with an intimate blend of fibers including flame resistant fiber, hydrophilic fibers, and anti-static fibers are described. The unique combination of fibers in the spun yarn and fabrics made therefrom provide a balance of high thermal properties, including flame resistance and thermal shrinkage resistance, as well as moisture management properties to provide both protection and comfort to the wearer. In addition, a spun yarn and fabric made therefrom may be dye accepting and/or can be printed thereon. In one embodiment, printable or dye accepting aramid fiber, or producer
(Continued)

dyed meta-aramid is utilized in the spun yarn. A fabric made with the spun yarn may have pre-wash softness that makes it comfortable to wear.

50 Claims, 10 Drawing Sheets

(51) Int. Cl.
*D02G 3/04* (2006.01)
*D02G 3/32* (2006.01)

(52) U.S. Cl.
CPC ..... *D02G 3/443* (2013.01); *D10B 2331/02* (2013.01); *D10B 2331/021* (2013.01); *D10B 2401/022* (2013.01); *D10B 2501/00* (2013.01); *D10B 2501/04* (2013.01); *Y10T 428/249921* (2015.04)

(58) Field of Classification Search
CPC .. A41D 1/06; A41D 3/02; C08L 33/20; C08L 2203/12; C08L 2205/03; C08L 2205/16; C08L 2666/86; Y10T 442/40; Y10T 442/3984; Y10T 428/249921; Y10T 442/444; Y10T 442/3146; Y10T 442/3382; Y10T 442/2525; Y10T 442/2418; Y10T 442/259; Y10T 442/3065; Y10T 442/2008; Y10T 442/313; Y10T 428/2913; Y10T 428/2909; Y10T 428/2936; Y10T 428/29; D03D 15/12; D03D 15/08; D03D 15/00; D03D 13/008; D03D 1/0041; Y10S 428/921; C08K 7/02; B32B 5/26; B32B 27/12; A62B 17/003; D10B 2401/02; D10B 2101/20; D10B 2201/02; D10B 2211/02; D10B 2211/04; D10B 2331/02; D10B 2331/021; D10B 2331/04; D10B 2401/061; D10B 2401/13; D10B 2401/14; D10B 2401/16; D10B 2401/22; D10B 2501/02; D10B 2501/04; D10B 2501/043; A41B 1/00; D04B 1/14
USPC ..... 2/85, 69, 93, 458; 428/221, 357, 364, 428/377, 919, 219; 57/252; 442/302, 442/304, 110, 123, 131, 60, 199; 524/34; 66/171; 139/384 R
See application file for complete search history.

(56) References Cited

U.S. PATENT DOCUMENTS

| | | | | |
|---|---|---|---|---|
| 4,107,129 | A | 8/1978 | Tanaka et al. | 524/505 |
| 4,988,746 | A | 1/1991 | Tanaka et al. | |
| 5,275,627 | A | 1/1994 | Cates et al. | |
| 5,356,700 | A * | 10/1994 | Tanaka | D02G 3/047 139/420 R |
| 7,156,883 | B2 * | 1/2007 | Lovasic | D02G 3/047 428/364 |
| 8,069,643 | B2 * | 12/2011 | Zhu | D02G 3/443 57/255 |
| 8,209,785 | B2 | 7/2012 | Underwood et al. | 2/458 |
| 2005/0032449 | A1 * | 2/2005 | Lovasic | D02G 3/047 442/209 |
| 2005/0287364 | A1 * | 12/2005 | Zhu et al. | 428/357 |
| 2008/0152888 | A1 * | 6/2008 | Tutterow et al. | 428/221 |
| 2010/0009186 | A1 * | 1/2010 | Zhu | 428/395 |
| 2010/0299817 | A1 | 12/2010 | Zhu | |
| 2011/0191949 | A1 * | 8/2011 | Underwood et al. | 2/458 |
| 2011/0250810 | A1 | 10/2011 | Zhu | |
| 2013/0254980 | A1 * | 10/2013 | Underwood et al. | 2/458 |

FOREIGN PATENT DOCUMENTS

| | | | |
|---|---|---|---|
| IN | 2937/DELN/2014 | | 10/2014 |
| WO | WO 2008/027454 | | 3/2008 |
| WO | WO 2011/008486 | | 1/2011 |
| WO | WO-2011/126999 | A1 | 10/2011 |
| WO | WO 2011/137213 | | 11/2011 |
| WO | WO 2012/016124 | | 2/2012 |
| WO | WO-2012/068600 | A1 | 5/2012 |
| WO | WO-2014/018221 | A1 | 1/2014 |
| WO | WO 2016/010659 | | 6/2015 |
| WO | WO-2016/010659 | A1 | 1/2016 |

OTHER PUBLICATIONS

International Search Report and Written Opinion mailed Oct. 11, 2013 for International Patent Application No. PCT/US2013/048521, which was filed Jun. 27, 2013 and published as WO 2014/018221 on Oct. 10, 2013 (Inventor—Robert W. Hines ; Applicant—Drifire, LLC; (9 pages).
Karvin Product Catalog and Preliminary Technical Information (1982) (11 pages).
McIntyre, "Aramid fibres", 44 Rev. Prog. Coloration, vol. 25, (1995) (7 pages).
International Search Report and Written Opinion of the International Searching Authority for application PCT/US2015/035783, filed on Jun. 15, 2015 and published as WO 2016/010659 on Jan. 21, 2016 (Applicant—Drifire, LLC // Inventor—Hines, et al.) (15 pages).
First Office Action issued by the State Intellectual Property Office of People's Republic of China on Jan. 13, 2016 for application 201380044738.1, filed on Jun. 28, 2013 and published as 10736750A on Jun. 24, 2015 (Applicant—Drifire, LLC // Inventor—Hines, et al.) (Original—20 pages // Translation—29 pages).
U.S. Appl. No. 62/024,619, filed Jul. 15, 2014, Hines (Drifire, LLC).
Extended European Search Report issued on Jul. 19, 2016 for application EP 13822850.7, filed on Jun. 28, 2013 and published as EP 2877619 on Jun. 3, 2015 (Applicant—Drifire, LLC // Inventor—Hines, et al.) (9 pages).
Second Office Action issued by the State Intellectual Property Office of People's Republic of China on Sep. 6, 2016 for application 201380044738.1, filed on Jun. 28, 2013 and published as CN 10736750A on Jun. 24, 2015 (Applicant—DriFire, LLC // Inventor—Hines, et al.) (Original—19 pages // Translation—32 pages).
Examination Report issued by IP Australia on Sep. 8, 2016 for application AU 2013293487, filed on Jun. 28, 2013 (Applicant—DriFire, LLC // Inventor—Hines, et al.) (3 pages).
Examination Report issued by IP Australia on Sep. 16, 2016 for application AU 2015224518, filed on Jun. 15, 2015 (Applicant—DriFire, LLC // Inventor—Hines, et al.) (2 pages).
International Preliminary Report on Patentability mailed on Nov. 3, 2016, for application PCT/US2015/035783, filed on Jun. 15, 2015 and published as WO 2016/010659 on Jan. 21, 2016 (Applicant—Drifire, LLC // Inventor—Hines, et al.) (10 pages).
Notification of Reasons for Refusal was issued on Feb. 28, 2017 by the Japan Patent Office for JP Application 20150524289 filed on Jun. 28, 2013 and published as JP2015524517 on Aug. 24, 2015 (Applicant—Drifire, LLC // Inventor—Hines, et al.) (Original—3 pages // Translation—3 pages).
Third Office Action issued by the State Intellectual Property Office of People's Republic of China on Jan. 23, 2017 for application 201380044738.1, filed on Jun. 28, 2013 and published as CN 10736750A on Jun. 24, 2015 (Applicant—Drifire, LLC // Inventor—Hines, et al.) (Original—4 pages // Translation—6 pages).

* cited by examiner

Moisure Measurement 0 Washes

| Item/Fabric | Fiber Content | Construction | Weight | Wet Pick-Up | Horizontal Wicking | Vertical Wicking Length (in 5 Minutes) | Vertical Wicking Durability | Total Dry-time (Total - 1% Moisture) | Dry-time in comfort zone (20 - 1% Moisture) | WRR (Total - 1% Moisture) | WRR in Comfort Zone (20 - 1% Moisture) |
|---|---|---|---|---|---|---|---|---|---|---|---|
| | | | Oz/Sq. Yd. | % | seconds | cm | | minutes | minutes | % per min | % per min |
| Comparative 1 | 92% Meta-Aramid / 5% Para-Aramid / 3% Conductive Fibers | Plain Weave | 4.6 | 1.70% | 100+ | 0.10 | 1.00 | 2.0 | 2.0 | 0.42 | 0.42 |
| Comparative 2 | 95% Meta-Aramid / 5% Para-Aramid | Plain Weave | 5.8 | 2.00% | 100+ | 0.20 | 0.50 | 2.9 | 2.9 | 0.35 | 0.35 |
| Comparative 3 | 92% Meta-Aramid / 5% Para-Aramid / 3% Conductive Fibers | Plain Weave | 6.9 | 28.7% | 3 | 6.5 | 0.42 | 41.1 | 30.5 | 0.69 | 0.64 |
| Fabric Example 1 Producer Colored | 60% Meta-Aramid / 15% FR Rayon / 13% Nylon / 10% Para-Aramid / 2% Anti-stat | Plain Weave | 5.0 | 32.30% | 2 | 6.40 | 0.73 | 58.4 | 40.1 | 0.54 | 0.48 |
| Fabric Example 2 Producer Colored | 60% Meta-Aramid / 15% FR Rayon / 13% Nylon / 10% Para-Aramid / 2% Anti-stat | Plain Weave | 5.5 | 32.2% | 2 | 7.90 | 0.96 | 56.1 | 38.4 | 0.56 | 0.5 |
| Fabric Example 3 Printed | 61% Nomex / 15% FR Rayon / 11% Nylon / 10% Para-Aramid / 3% Anti-stat | Plain Weave | 5.5 | 27.40% | 1 | 5.90 | 0.64 | 49.9 | 39.8 | 0.53 | 0.48 |

FIG. 3

Moisture Management 30 Washes

| Item/Fabric | Fiber Content | Construction | Weight | Wet PickUp | Horizontal Wicking | Vertical Wicking Length (in 5 Minutes) | Total Dry-time (Total-1% Moisture) | Dry-time in comfort zone (20-1% Moisture) | WRR (Total - 1% Moisture) | WRR in Comfort Zone (20-1% Moisture) |
|---|---|---|---|---|---|---|---|---|---|---|
| | | | Oz/Sq. Yd. | % | seconds | cm | minutes | minutes | % per min | % per min |
| Comparative 1 | 92% Meta-Aramid / 5% Para-Aramid / 3% Conductive Fibers | Plain Weave | 4.6 | 1.40% | 100+ | 0.10 | 3.1 | 2.3 | 0.16 | 0.18 |
| Comparative 2 | 95% Meta-Aramid / 5% Para-Aramid / | Plain Weave | 5.8 | 31.00% | 100+ | 0.10 | 52.6 | 38.6 | 0.58 | 0.5 |
| Comparative 3* | 92% Meta-Aramid / 5% Para-Aramid / 3% Conductive Fibers | Plain Weave | 7.0 | 37.9% | 42 | 2.7 | 70.1 | 46.8 | 0.52 | 0.40 |
| Fabric Example 1 Producer Colored | 60% Meta-Aramid / 15% FR Rayon / 13% Nylon / 10% Para-Aramid / 2% Anti-stat | Plain Weave | 5.0 | 37.30% | 5 | 8.10 | 59.9 | 38.6 | 0.60 | 0.48 |
| FabricExample2 Producer Colored | 60% Meta-Aramid / 15% FR Rayon / 13% Nylon / 10% Para-Aramid / 2% Anti-stat | Plain Weave | 5.5 | 36.7% | 3 | 8.20 | 82.0 | 59.6 | 0.44 | 0.32 |
| Fabric Example 3 Printed | 61% Meta-Aramid / 15% FR Rayon / 11% Nylon / 10% Para-Aramid / 3% Anti-stat | Plain Weave | 5.5 | 32.80% | 100 | 3.80 | 71.5 | 50.6 | 0.43 | 0.36 |

*25 washes

FIG. 4

Fabric Example 1

Test, Unit of Measure

Tested as received

| Length | Specimen Results | | | | | Average |
|---|---|---|---|---|---|---|
| After Flame, sec. | 0 | 0 | 0 | 0 | 0 | 0 |
| After Glow, sec. | 0.6 | 0.7 | 0.6 | 0.7 | 0.4 | 0.6 |
| Char Length, in. | 3 | 3.8 | 3.7 | 3.1 | 3 | 3.32 |

| Width | | | | | | |
|---|---|---|---|---|---|---|
| After Flame, sec. | 0 | 0 | 0 | 0 | 0 | 0 |
| After Glow, sec. | 0.5 | 0.5 | 0.6 | 0.5 | 0.5 | 0.52 |
| Char Length, in. | 3.5 | 3.7 | 3.3 | 4.2 | 2.9 | 3.52 |

Fabric weight; oz/yd² 4.900327

Tearing force; grams 100

Tested after 5 launderings

| Length | | | | | | |
|---|---|---|---|---|---|---|
| After Flame, sec. | 0 | 0 | 0 | 0 | 0 | 0 |
| After Glow, sec. | 0.6 | 0.7 | 0.6 | 0.8 | 0.8 | 0.7 |
| Char Length, in. | 3.2 | 2.8 | 2.7 | 2.5 | 2.2 | 2.68 |

| Width | | | | | | |
|---|---|---|---|---|---|---|
| After Flame, sec. | 0 | 0 | 0 | 0 | 0 | 0 |
| After Glow, sec. | 0.7 | 0.5 | 0.7 | 0.5 | 0.6 | 0.6 |
| Char Length, in. | 4.2 | 3.6 | 3.4 | 3 | 3.6 | 3.56 |

Fabric weight; oz/yd² 4.900327

Tearing force; grams 100

* Laundered to FTM 191-5556 & Footnote 2 by TexTest in Valley, AL.

FIG. 5

Fabric Example 2

| Test, Unit of Measure | Specimen Results | | | | | Average |
|---|---|---|---|---|---|---|
| Tested as received | | | | | | |
| Length | | | | | | |
| After Flame, sec. | 0 | 0 | 0 | 0 | 0 | 0 |
| After Glow, sec. | 0.5 | 0.7 | 0.4 | 0.7 | 0.5 | 0.56 |
| Char Length, in. | 2.7 | 2.8 | 2.6 | 3.2 | 2.1 | 2.68 |
| Width | | | | | | |
| After Flame, sec. | 0 | 0 | 0 | 0 | 0 | 0 |
| After Glow, sec. | 0.5 | 0.6 | 0.4 | 0.5 | 0.6 | 0.52 |
| Char Length, in. | 2.9 | 3.1 | 3.5 | 2.6 | 3.7 | 3.16 |
| Fabric weight; oz/yd² | 5.23694 | | | | | |
| Tearing force; grams | 100 | | | | | |
| Tested after 5 launderings | | | | | | |
| Length | | | | | | |
| After Flame, sec. | 0 | 0 | 0 | 0 | 0 | 0 |
| After Glow, sec. | 0.6 | 0.8 | 0.7 | 0.6 | 0.8 | 0.7 |
| Char Length, in. | 3.6 | 3.2 | 3.2 | 3 | 3 | 3.2 |
| Width | | | | | | |
| After Flame, sec. | 0 | 0 | 0 | 0 | 0 | 0 |
| After Glow, sec. | 0.7 | 0.9 | 0.5 | 0.8 | 0.8 | 0.74 |
| Char Length, in. | 2.8 | 3.3 | 3.6 | 3.1 | 3.4 | 3.24 |
| Fabric weight; oz/yd² | 5.23694 | | | | | |
| Tearing force; grams | 100 | | | | | |

FIG. 6

Fabric Example 3

| Test, Unit of Measure | Specimen Results | | | | | Average |
|---|---|---|---|---|---|---|
| **As Received** | | | | | | |
| Length | | | | | | |
| After Flame, sec. | 0.0 | 0.0 | 0.0 | 0.0 | 0.0 | 0.0 |
| After Glow, sec. | 1.0 | 1.8 | 1.9 | 1.7 | 1.3 | 1.5 |
| Char Length, in. | 2.8 | 2.7 | 2.4 | 2.6 | 2.6 | 2.6 |
| Width | | | | | | |
| After Flame, sec. | 0.0 | 0.0 | 0.0 | 0.0 | 0.0 | 0.0 |
| After Glow, sec. | 1.9 | 1.1 | 1.4 | 1.4 | 1.3 | 1.4 |
| Char Length, in. | 3.7 | 4.0 | 3.5 | 3.9 | 4.0 | 3.8 |
| Fabric weight; oz/yd² | 5.6 | | | | | |
| Tearing force; grams | 100 | | | | | |
| **After 5 launderings IAW FTM 191A-5556*** | | | | | | |
| Length | | | | | | |
| After Flame, sec. | 0.0 | 0.0 | 0.0 | 0.0 | 0.0 | 0.0 |
| After Glow, sec. | 0.0 | 0.0 | 0.0 | 0.0 | 0.0 | 0.0 |
| Char Length, in. | 4.3 | 3.7 | 4.0 | 3.2 | 3.5 | 3.7 |
| Width | | | | | | |
| After Flame, sec. | 0.0 | 0.0 | 0.0 | 0.0 | 0.0 | 0.0 |
| After Glow, sec. | 0.0 | 0.0 | 0.0 | 0.0 | 0.0 | 0.0 |
| Char Length, in. | 3.2 | 3.5 | 3.5 | 3.4 | 3.9 | 3.5 |
| Fabric weight; oz/yd² | 6.5 | | | | | |
| Tearing force; grams | 200 | | | | | |

FIG. 7

| | | | Predicted Burn % | | |
|---|---|---|---|---|---|
| Fabric | Burn # | Flame Exposure (sec) | 2nd | 3rd | Overall |
| Example 1 | 1 | 4 | 27.9 | 7.4 | 35.3 |
| Example 1 | 2 | 4 | 28.7 | 9 | 37.7 |
| Example 1 | 3 | 4 | 26.2 | 8.2 | 34.4 |
| | | Average | 27.6 | 8.2 | 35.8 |

| | | | Predicted Burn % | | |
|---|---|---|---|---|---|
| Fabric | Burn # | Flame Exposure (sec) | 2nd | 3rd | Overall |
| Example 2 | 1 | 4 | 22.1 | 7.4 | 29.5 |
| Example 2 | 2 | 4 | 20.5 | 8.2 | 28.7 |
| Example 2 | 3 | 4 | 21.9 | 7.7 | 29.5 |
| | | Average | 21.6 | 7.7 | 29.5 |

| | | | Predicted Burn % | | |
|---|---|---|---|---|---|
| Fabric | Burn # | Flame Exposure (sec) | 2nd | 3rd | Overall |
| Example 3 | 1 | 4 | 24.59 | 8.2 | 32.8 |
| Example 3 | 2 | 4 | 27.05 | 9.0 | 36.1 |
| Example 3 | 3 | 4 | 24.59 | 8.2 | 32.8 |
| | | Average | 25.4 | 8.5 | 33.9 |

FIG. 8

| Item/Fabric | Fiber Content | Construction | Weight | Dimensional Stability (AATCC 135) | Pilling Resistance Random Tumble Method (ASTM D 3512) | Martindale Abrasion Resistance (ASTM D 4966) | Dry Abrasion | Wet Abrasion |
|---|---|---|---|---|---|---|---|---|
| | | | Oz/Sq. Yd. | % Shrinkage | Rating | Rating | No of cycles to form a hole in fabric | |
| Comparative 1 | 92% Meta-Aramid / 5% Para-Aramid / 3% Conductive Fibers | Plain Weave | 4.6 | 1.00% | 2 | 4.5 | 3000 | 1500 |
| Comparative 2 | 95% Meta-Aramid / 5% Para-Aramid | Plain Weave | 5.8 | 1.50% | 5 | 5 | 3500 | 1500 |
| Comparative 3 | 92% Meta-Aramid/ 5% Para-Aramid/ 3% Conductive Fiber | Plain Weave | 6.9 | N/A | N/A | N/A | N/A | N/A |
| Fabric Example 1 Producer Colored | 63% Nomex / 15% FR Rayon / 9% Nylon / 10% Para-Aramid / 3% Anti-stat | Plain Weave | 5.0 | 2.50% | 4.33 | 5 | 4000 | 3000 |
| Fabric Exampe 2 Printed | 63% Nomex / 15% FR Rayon / 9% Nylon / 10% Para-Aramid / 3% Anti-stat | Plain Weave | 5.5 | 2.50% | 4.16 | 4.5 | 7000 | 3000 |
| Fabric Example 3 Printed | 61% Nomex / 15% FR Rayon / 11% Nylon / 10% Para-Aramid / 3% Anti-stat | Plain Weave | 5.5 | 2.50% | 4.83 | 5 | 7000 | 4000 |

FIG. 9

FIBER BLENDS FOR WASH DURABLE THERMAL AND COMFORT PROPERTIES

CROSS-REFERENCE TO RELATED APPLICATIONS

This application is a U.S. National Phase Application of International Application No. PCT/US2013/048521, filed on Jun. 28, 2013, which claims priority to U.S. Patent Application No. 61/676, 518, filed Jul. 27, 2012, each of which is hereby incorporated by reference in its entirety.

FIELD OF THE INVENTION

The present invention generally relates to fiber blends. More particularly, the invention relates to fiber blends used for a balance of high thermal and comfort properties and to the spun yarns, fabrics, and garments made from the fiber blends.

BACKGROUND OF THE INVENTION

Flame resistant fabrics (also variously referred to as "FR", "fire-resistant," "flame-retardant," and "fire-retardant" fabrics) are fabrics that, once ignited, tend not to sustain a flame when the source of ignition is removed. Considerable research has been directed toward the development and improvement of flame-resistant fabrics for use in various products, including clothing and bedding. Flame-resistant clothing is often worn by workers involved in activities such as industrial manufacturing and processing (such as oil, gas, and steel industries), fire-fighting, electrical utility work, military work, and other endeavors that entail a significant risk of being exposed to open flame, flash fire, momentary electrical arcs, and/or molten metal splash. Non-flame resistant work clothes can ignite and will continue to burn even after the source of ignition has been removed. Untreated natural fabrics will continue to burn until the fabric is totally consumed and non-flame resistant synthetic fabrics will burn with melting and dripping causing severe contact burns to the skin. A significant amount of severe and fatal burn injuries are due to the individual's clothing igniting and continuing to burn, not by the exposure itself. Abrasion resistance of protective fabrics is also important, as garments that have developed failures such as holes and rips can compromise the protective properties of the fabric.

Flame-resistant fabrics include both fabrics that are treated to be flame-resistant as well as fabrics made from inherently flame-resistant fibers. The former types of fabrics are not themselves flame-resistant, but are made flame-resistant by applying to the fabric a chemical composition that renders the fabric resistant to flame. These types of fabrics are susceptible to losing their flame-resistance with repeated laundering because the flame-resistant composition tends to wash out and/or be impacted by common laundry additives. In contrast, inherently flame-resistant fabrics do not suffer from this drawback because they are made from fibers that are themselves flame-resistant. The use of flame resistant clothing provides thermal protection to areas of the body covered by the garment. The level of protection typically rests in the fabric weight, construction, and composition. After the source of the ignition is removed, flame resistant garments will self-extinguish, limiting the body burn percentage.

Flame-resistant fabrics may contain a low percentage of natural fibers and have limited comfort properties such as adsorption of water. Flame-resistant fabrics are most often worn in work environments and comfort, including absorption of sweat from the skin, is an important performance factor, especially in extreme conditions such as firefighting. Combining some percentage of natural hydrophilic fibers with FR fibers may provide some improvement in comfort and moisture wicking, however this typically comes at a loss of FR performance properties. Most FR fibers, including aramid fibers, are hydrophobic and do not provide high comfort performance. Adding a high concentration of hydrophilic fibers however may negatively impact moisture management properties and/or fire resistance properties. In addition, garments made from fabrics having high percentage content of hydrophilic fibers, may become oversaturated with moisture, such as from sweat, and cause steam burns when expose to a high temperature.

In addition, fabrics made with a high percentage of aramid fibers, including meta-aramid and/or para-aramid, fibers are typically stiff, have poor softness or drape properties and are generally uncomfortable to wear. The softness of fabrics made with a high percentage of aramid fibers may be improved by repeated washings but tend to become more hydrophobic. Therefore, many industrial workers, pilots, and emergency responders repeatedly wash garments made with high percentages of aramid fibers to increase comfort, even washing new garments many times prior to the initial use. Unfortunately, many of these garments are made with hydrophobic and/or hydrophilic coatings that can lose effectiveness with repeated washings. Therefore, washed treated garments may have improved softness but decreased moisture management properties.

Various types of inherently FR fibers have been developed, including modacrylic fibers (e.g., modacrylic fibers sold under the PROTEX name from Kaneka Corporation of Osaka, Japan, and Tairylan sold by Formosa Plastics of Taiwan). Acrylic based FR fibers sold under the name PyroTex, (Hamburg, Germany), aramid fibers (e.g., meta-aramid fibers sold under the NOMEX name and para-aramid fibers sold under the KEVLAR name, both from E. I. Du Pont de Nemours and Company of Wilmington, Del.), FR rayon fibers (Sold under the Lenzing FR name, from Lenzing Group, Austria), oxidized polyacrylonitrile fibers, and others. It is common to blend one or more types of FR staple fibers with one or more other types of non-FR staple fibers to produce a fiber blend from which yarn is spun; the yarn then being knitted or woven into fabrics for various applications. In such a fiber blend, the FR fibers render the blend flame-resistant even though some fibers in the blend may themselves be non-FR fibers, because, in the case of antimony—and halogen—filled fibers, when the FR fibers are exposed to heat and flame they release non-combustible gases that tend to displace oxygen and thereby extinguish any flame. In addition to char formation, and having high Oxygen Limiting Indexs (LOI), many FR fibers are poor conductors of heat. In the case of non-filled FR fibers the high percentage of FR fibers form char, or exhibit other characteristics which provide wearer protection.

In addition to the above-noted performance specifications of fabrics, other properties are also important if a fabric is to be practical and commercially viable, particularly for clothing. For instance, the fabric should be durable under repeated industrial and home launderings and should have good abrasion-resistance. Furthermore, the fabric should be comfortable to wear. Unfortunately, many of the FR blends are not comfortable under typical environmental conditions. In such cases, wearers tend to be less likely to be compliant and thereby decreasing the probability that the wearer will continue to use the garment as intended. Thus, it is beneficial if a FR fabric exhibits good moisture management properties, i.e., ability to wick away sweat and dry quickly, so that the wearer does not become overheated or chilled, and/or the fabric does not irritate the wearer's skin.

Furthermore, many inherently FR fibers and especially most aramid type FR fibers are not dye accepting. It is desirable in most applications to have FR fabric that is dye accepting or "printable". In some cases fibers may be purchased that are producer colored, however this limits the color options available to the fabric manufacturer.

Selection of a fiber blend to meet a plurality of the requirements as described, while being affordable is a constant challenge. Some (FR) fibers and especially inherently FR fibers that are thermally shrink resistant, as defined herein, are relatively expensive and incorporating a high percentage of these fibers into a yarn and fabric may be cost prohibitive for many applications.

Woven FR fabrics are well suited for meeting the requirements of the FR test protocols, including NFPA 2112 and especially the thermal shrinkage tests. Woven fabrics are relatively tight, having little void volume between yarns, therein reducing the propensity to thermally shrink. Other types of fabric structures, such as knits, may be more comfortable to wear as they typically have higher porosities. However, knit fabric may not meet the thermal shrinkage requirements. The yarns in a knit fabric are looped and therefore not as restrained as yarns in a conventional woven fabric and therefore can shrink more.

There exists a need for a spun yarn and fabrics or garments made therefrom that is both flame resistant, while also providing superior moisture management properties and strength properties to improve wearer compliance. In addition, there exists a need for flame resistant garments made with inherently FR fibers that are comfortable to wear prior to repeated launderings. Furthermore, there exists a need for a spun yarn and flame resistant fabric made therefrom that is dye accepting and/or can have a color or pattern printed thereon. The fiber blends, yarns, fabrics, and garments of the present invention are directed toward these, as well as other, important ends.

SUMMARY OF THE INVENTION

The invention relates generally to spun yarns comprising an intimate blend of fibers and to fabrics and garments comprising the spun yarns as described herein. Fabrics made with the spun yarn of the present invention may achieve a balance of high thermal properties, including flame resistance and thermal shrinkage resistance, as well as moisture management properties to provide both protection and comfort to the wearer. In addition, a fiber blend or fabric made therefrom of the present invention may be dye accepting and/or can be printed thereon.

Accordingly, in one embodiment the invention is directed to spun yarns and fabrics and articles, such as garments made therefrom, comprising: about 44 to 80 weight % meta-aramid fiber; about 0 to 15 weight % nylon fiber; about 5 to 15 weight % para-aramid; about 2 to 5 weight % anti-static fiber, and about 10 to 15 weight % hydrophilic fiber; wherein fibers are intimately blended. In an exemplary embodiment, the spun yarn comprises about 85 to 90% hydrophobic component, and about 10 to 15 weight % hydrophilic component. The hydrophilic component may, in an exemplary embodiment, consist essentially of the hydrophilic fiber selected from the group of cellulose, cellulose derivatives, wool, FR acrylic derivative fibers and combinations thereof. The hydrophilic fiber component, or a portion thereof, may be flame resistant. The hydrophobic component may, in an exemplary embodiment, consists essentially of about 44 to 80 weight % meta-aramid fiber; about 0 to 15 weight % nylon fiber; about 5 to 15 weight % para-aramid; and about 2 to 5 weight % anti-static fiber. In yet another exemplary embodiment, the spun yarn consists essentially of about 44 to 80 weight % meta-aramid fiber; about 0 to 15 weight % nylon fiber; about 5 to 15 weight % para-aramid; about 2 to 5 weight anti-static fiber; and about 0 to 15 weight % hydrophilic fiber. In some embodiments, a majority, greater than 50% by weight, of the fiber blend in the spun yarn is aramid fiber. In another embodiment, more than about 85% by weight of the fiber blend in the spun yarn is flame resistant. In yet another embodiment, more than 60%, and preferably more than 62% by weight of the fiber blend is meta-aramid fiber.

In an exemplary embodiment the invention is directed to spun yarns and fabrics and articles, such as garments made therefrom, comprising: about 55 to 70 weight % meta-aramid fiber; about 7 to 15 weight % nylon fiber; about 5 to 15 weight % para-aramid; about 2 to 5 weight % anti-static fiber, and about 10 to 15 weight hydrophilic fiber; wherein fibers are intimately blended.

In an exemplary embodiment the invention is directed to spun yarns and fabrics and articles, such as garments made therefrom, comprising: more than about 62 weight % meta-aramid fiber; about 0 to 15 weight % nylon fiber; about 5 to 15 weight % para-aramid; about 2 to 5 weight % anti-static fiber, and about 10 to 15 weight % hydrophilic fiber; wherein fibers are intimately blended. In another exemplary embodiment, invention is directed to spun yarns and fabrics and articles, such as garments made therefrom, consisting essentially of: more than about 62 weight % meta-aramid fiber; about 0 to 15 weight % nylon fiber; about 5 to 15 weight % para-aramid; about 2 to 5 weight % anti-static fiber, and about 10 to 15 weight % hydrophilic fiber; wherein fibers are intimately blended.

The meta-aramid fiber component of the spun yarn may be printable, having a low crystallinity. In another embodiment, the meta-aramid fiber is producer colored, having some color introduced, such as by die or pigment, to the polymer and/or fiber during manufacturing.

Fabrics made from the spun yarns described herein may have an initial softness that makes it comfortable to wear as received, and may not require repeated washing to reduce stiffness. In an exemplary embodiment, a fabric of the present invention comprises a spun yarn comprising: about 44 to 80 weight % meta-aramid fiber; about 0 to 15 weight % nylon fiber; about 5 to 15 weight % para-aramid; about 2 to 5 weight % anti-static fiber, and about 10 to 15 weight % hydrophilic fiber; wherein fibers are intimately blended.

Any suitable article such as a garment including, but not limited to, socks, balaclavas, hats, pants, shirts, jackets, coveralls, undergarments and the like may be made from the fabrics comprising the spun yarn as described herein.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain principles of the invention.

FIG. 3 is a chart showing moisture management performance results of comparative and exemplary fabrics described herein.

FIG. 4 is a chart showing moisture management performance results of comparative and exemplary fabrics after thirty washes.

FIG. 5 is a chart showing FR performance results of fabric example 1 described herein.

FIG. 6 is a chart showing FR performance results of fabric example 2 described herein.

FIG. 7 is a chart showing FR performance results of fabric example 3 described herein.

FIG. 8 is a chart showing the predicted burn results of fabric examples 1-3 as described herein.

FIG. 9 is a chart showing abrasion performance results of exemplary fabrics described herein.

Figure 1:
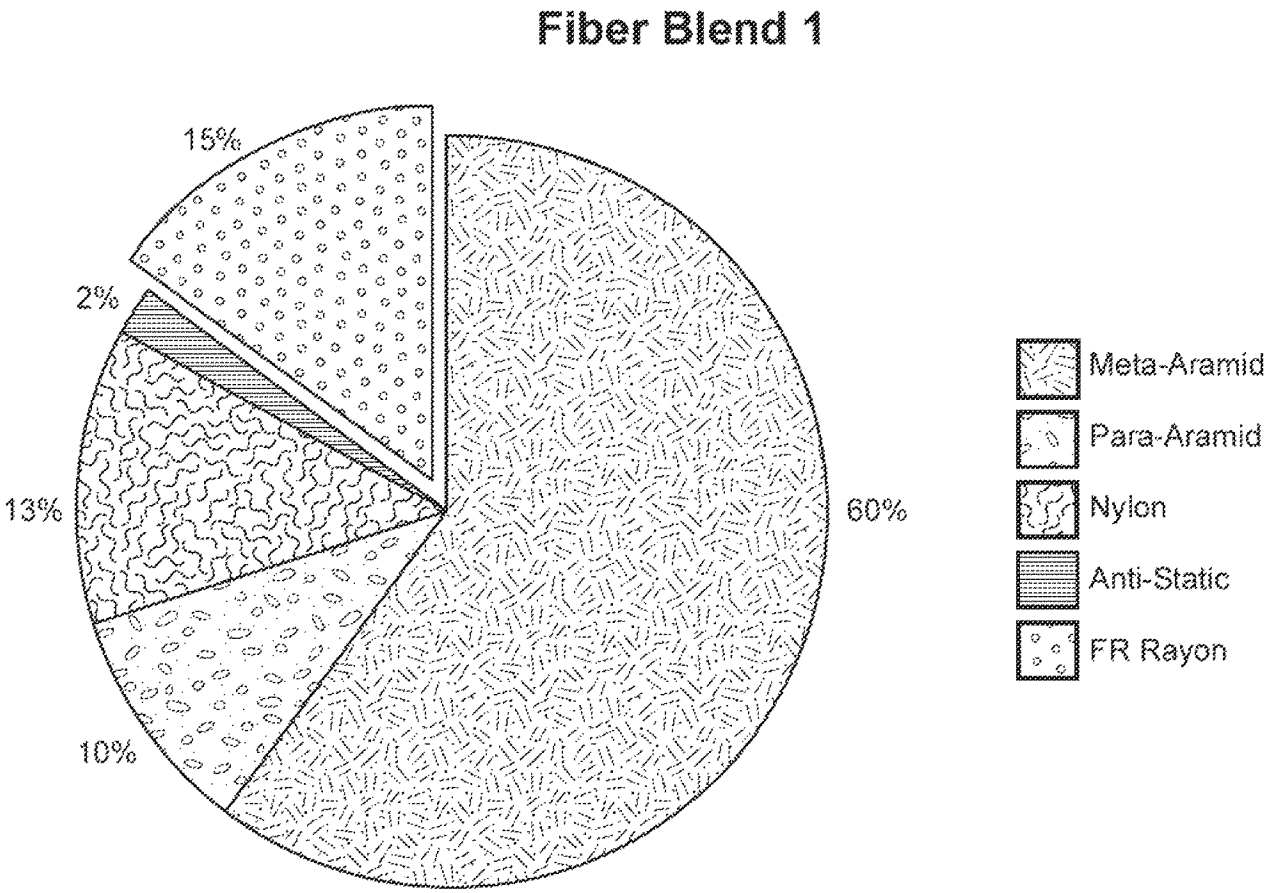
FIG. 1 is a pie graph showing the fiber blend concentrations of Fiber Blend 1, an exemplary embodiment described herein.

The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As employed above and throughout the disclosure, the following terms, unless otherwise indicated, shall be understood to have the following meanings.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

As used herein, with reference to spun yarn, fabric, or articles such as garments made therefrom, the term "consisting essentially of" means that the yarn, fabric or article is made primarily of a described component or components, such as a polymer, material or fiber type and may include small amounts, less than 5% by weight of additional treatments, coating or finishes.

As used herein, with reference to fabric, the term "formed substantially of" means that the fabric includes at least 50% by weight, based on the total weight of the fabric, preferably at least 75% by weight, based on the total weight of the fabric, or preferably at least 80% by weight, based on the total weight of the fabric and more preferably at least 90% by weight, based on the total weight of the fabric, of a specific fiber blend or spun yarn composition. It is to be understood that a fabric, as described herein, may comprise additional coating or additives as required for various applications.

As used herein, the term "aramid fiber" refers to a manufactured fiber in which the fiber-forming substance is a long-chain synthetic polyamide in which at least 85% of the amide linkages, (—CO—NH—), are attached directly to two aromatic rings, including, but not limited to, para-aramid (p-aramid) and meta-aramid (m-aramid). Aramid fiber is a strong, heat-resistant fiber formed of polymers with repeating aromatic groups branching from a carbon backbone, used in materials for bulletproof vests and radial tires. Also called polyaramid. Examples of para-aramids include, but are not limited to, (poly(p-phenylene terephthalamide), e.g., KEVLAR® (E.I. du Pont de Nemours and Company), TWARON® (Teijin Twaron BV), and TECHNORA by Teijin Company. KEVLAR is a para-aramid fiber having a very high tenacity of between 28 and 32 grams/denier and outstanding heat resistance. Examples of meta-aramids include, but are not limited to, (poly(m-phenylene isophthalamide), such as NOMEX® (E.I. du Pont de Nemours and Company) and CONEX® (Teijin Twaron BV). Unlike Kevlar, Nomex cannot align during filament formation and is typically not as strong as para-aramid or KEVLAR. Meta-aramid however has excellent thermal, chemical, and radiation resistance. Preferably, the fiber blend described herein comprises a structural fiber. One example of a structural fiber is p-aramid, microdenier p-aramid. Such structural fibers feature excellent thermal stability and are highly non-flammable. These fibers have a very high resistance to heat and are resistant to melting, dripping and burning at a temperature of at least 700° F. Moreover, their Limiting Oxygen Index (LOI) value is preferably in the range of between about 28 and about 30. The LOI represents the minimum oxygen concentration of an $O_2/N_2$ mix required to sustain combustion of a material. The LOI is determined by the ASTM Test D 2862-77. Meta-aramids and para-aramids are inherently hydrophobic but in some cases may be treated to render them hydrophilic, at least temporarily. In an exemplary embodiment, the fiber blend as described herein is comprised of a majority of aramid fibers, such as approximately 60% meta-aramid and approximately 10% para-aramid.

Most aramid fibers are not dye accepting and when incorporated into a fiber blend in a high concentration can significantly limit the color ranges possible for a fabric. However, some aramid fibers are printable, or dye accepting. For example, a low crystallized type meta-aramid fiber, such as Nomex 462 available from E.I. du Pont de Nemours and Company, is a printable meta-aramid. In addition, some meta-aramid fibers are available as producer colored meta-aramids, wherein fibers are colored during manufacturing of the fibers.

As used herein, the term "modacrylic fiber" refers to an acrylic synthetic fiber made from a polymer comprising primarily residues of acrylonitrile, especially polymers that have between 35 to 85% acrylonitrile units, and which may be modified by other monomers. Modacrylic fibers are spun from an extensive range of copolymers of acrylonitrile. The modacrylic fiber may contain the residues of other monomers, including vinyl monomer, such as but not limited to vinyl chloride, vinylidene chloride, vinyl bromide, vinylidene bromide, and the like. The types of modacrylic fibers that can be produced within this broad category are capable of wide variation in properties, depending on their composition. FR acrylic derivative fibers, as used herein includes modacrylic fibers as described herein and any fiber comprising acrylic monomer units, including acrylic FR fibers sold under the name Pyro-Tex, (Hamburg, Germany). Some examples of commonly available modacrylics are PROTEX™, KANEKALON™, KANECARON™ by Kaneka Corporation. Modacrylic fibers have excellent fire retardancy performance combined with non-melt, non-drip and self-extinguishing properties. Modacrylics have a high so-called LOI value as compared with other fibers.

As used herein, the term "anti-static fiber" or conductive refers to a fiber that, when incorporated into a fabric or other material, eliminates or reduces static electricity. Suitable fibers include, but are not limited to, metal fibers (steel, copper or other metal), metal-plated polymeric fibers, and polymeric fibers incorporating carbon black on the surface and/or in the interior of the fiber, such as those described in U.S. Pat. Nos. 3,803,453, 4,035,441, 4,107,129, and the like. Anti-static carbon fiber is a preferred anti-static fiber. One example of a conductive fiber is NEGASTAT®, produced by E.I. du Pont de Nemours and Company, a carbon fiber comprising a carbon core of conductive carbon surrounded by a non-conductive polymer cover, either nylon or polyester. Another anti-static fiber example is RESISTAT®, available from Shakespeare Conductive Fibers LLC; a fiber where the fine carbon particles are embossed on the surface of a nylon filament. By way of example, a steel wire is available under the names BEKINOX and BEKITEX from Bekaert S.A. in a diameter as small as 0.035 millimeter. Another anti-static fiber is the product X-static made by Noble Fiber Technologies, a nylon fiber coated with a metal (silver) layer. The X-static fibers may be blended with other fibers, such as meta-aramid, in the process of yarn spinning.

As used herein, the term "nylon fiber" refers to a fiber consisting essentially of a polyamide synthetic polymer. Polyamide is a thermoplastic having high abrasion resistance and toughness. Addition of nylon fiber to the fiber blend may increase abrasion resistance of a fabric.

As used herein, the term "cellulosic derivative fiber" refers to a fiber that comprises a substantial concentration of cellulosic, and/or cellulosic derivative material. A cellulosic derivative fiber may comprise any suitable type or combination of cellulosic derivative fibers including, but not limited to, cotton, cellulose, cellulose derivatives, rayon. A cellulosic derivative fiber may comprise a treatment to render it flame resistant. In most cases, a cellulosic derivative fiber is inherently hydrophilic. However, a cellulosic derivative fiber may comprise treatments to render the fiber hydrophobic, hydrophilic or oleophobic.

As used herein, the term "hydrophilic," as it refers to a fabric, means that the fabric has a horizontal wicking of less than about twenty seconds. A yarn or blend of yarns may be considered to be hydrophilic when a fabric made therefrom has a horizontal wicking time of less than about ten seconds and more preferably less than five seconds based upon the AATCC 79 Test Method for horizontal wicking. In an exemplary embodiment, the hydrophilic fiber component consists essentially of hydrophilic fiber selected from the group consisting of selected from cellulose, cellulose derivatives, wool, and combination thereof. In an exemplary embodiment, the hydrophilic fiber consists essentially of cellulose, cellulose derivative, wool, FR acrylic derivative fiber and combinations thereof.

As used herein, with reference to fibers, yarns and fabric made therefrom, the term "thermally shrink resistant", means that the said fabrics meet the thermal shrinkage resistance requirements of NFPA 2112-0.7 Ed, Section 8.4, and has less than 10% shrinkage according to the test described herein.

Some specialty fibers are thermally shrink resistant, and when incorporated into a fiber blend may provide enough thermal shrink resistance to allow the yarn or fabric made therewith to meet thermal shrinkage requirements. Suitable thermally shrink resistant fibers include, but are not limited to, FR acrylic derivative fibers (e.g., PyroTex, Hamburg, Germany), polyacrylonitrile (PAN), aramid fibers (e.g., meta-aramid fibers sold under the NOMEX name and para-aramid fibers sold under the KEVLAR name, both from E. I. Du Pont de Nemours and Company of Wilmington, Del.), and the like FR Rayon, FR Cotton, Basofill etc. In some embodiments, a thermally shrink resistant fiber may be hydrophilic and/or dye accepting, as used herein to mean that the fiber may accept a die to substantially and durably impart a color to the fiber. Durably impart a color to the fiber means that the fiber will substantially retain the color after three or more wash cycles, and preferably after 10 or more wash cycles and more preferably after 25 was cycles.

As used herein, the term "basis weight" refers to a measure of the weight of a fabric per unit area. Typical units include ounces per square yard and grams per square centimeter.

As used herein, with reference to vertical wick height, the term durability is the absolute value of the percent difference of the 30 wash vertical wicking height and the pre-wash vertical wicking height subtracted from one:

$$1-|(VWH_{30}-VWH_{pw})/VWH_{pw})|,$$

Where: $VWH_{30}$ is the vertical wicking height after 30 washes, and $VWH_{pw}$ is the prewash vertical wicking height.

The term and calculation for durability may be applied to other performance metrics as well including, but not limited to, horizontal wicking, wet pick-up, WRR, comfort zone WRR, total dry time, comfort zone dry time, dry abrasion, wet abrasion, after flame time, char length, predicted burn percentage, dimensional stability, piling resistance, Martindale abrasion and the like. In addition, the durability may be calculated using data for pre-wash samples and samples after any number of washes, including for example five washes.

As used herein, the term weight %, unless otherwise noted, refers to the weight % based on the total weight of the spun yarn.

As used herein, the term "garment" refers to any article of clothing or clothing accessory worn by a person, including, but not limited to shirt, pants, underwear, outer wear, footwear, headwear, swimwear, belts, gloves, headbands, socks, balaclavas and wristbands.

As used herein, the term "linen" (when not in relation to the hydrophilic fiber) refers to any article used to cover a worker or seating equipment used by workers, including, but not limited to sheets, blankets, upholstery covering, vehicle upholstery covering, and mattress covering.

As used herein, the term "intimately blended," when used in conjunction with a yarn, refers to a statistically random mixture of the staple fiber components in the yarn.

The invention relates generally to spun yarns comprising a fiber blend and to fabrics and garments comprising the spun yarns that achieve a balance of high thermal properties, including flame resistance and thermal shrinkage resistance, as well as moisture management properties to provide both protection and comfort to the wearer. In addition, a spun yarn, fabric or article made therefrom of the present invention may be dye accepting and/or can be printed thereon. In yet another embodiment, a fabric made from a spun yarn described herein, is flame resistant and has high moisture management properties having a vertical wicking height of at least 4 cm, and a comfort zone drying time less than 40 minutes.

Accordingly, in one embodiment, the invention is directed to spun yarns and fabrics made therefrom, comprising: about 44 to 80 weight % meta-aramid fiber; about 0 to 15 weight % nylon fiber; about 5 to 15 weight % para-aramid; about 2 to 5 weight % anti-static fiber, and about 10 to 15 weight % hydrophilic fiber; wherein fibers are intimately blended. In an exemplary embodiment, the spun yarn comprises about 85 to 90 weight % hydrophobic component, and about 10 to 15 weight % hydrophilic component. In some embodiments, the meta-aramid component is a printable meta-aramid that is specifically engineered for accepting dyes and/or prints. A printable meta-aramid may comprise a low crystallized type meta-aramid. Nomex 462 is a printable type of meta aramid, available from E.I. Dupont Nemours (E. I. du Pont de Nemours), Wilmington, Del. In another exemplary embodiment, a producer colored meta-aramid may be used in the fiber blend, described herein. In addition, any combination of printable and producer colored meta-aramids may be used in the fiber blend. In an exemplary embodiment, the para-aramid fiber component of the fiber blend is a dyed or colored para-aramid. In an exemplary embodiment, the meta-aramid fiber component of the spun yarn may be present at a level of about 60 to 63% by weight, based on the weight of the spun yarn. The nylon fiber component of the spun yarn may be present at a level of about 10 to 12% by weight, based on the weight of the spun yarn. The para-aramid fiber component of the spun yarn may be present at a level of about 10-12% by weight, based on the weight of the spun yarn. The anti-static fiber component of the spun yarn may be present at a level of about 2 to 3.5% by weight, based on the weight of the spun yarn. The hydrophilic fiber component of the spun yarn may be present at a level of about 12% by weight, based on the weight of the spun yarn. The meta-aramid fiber may be included in the spun yarn at any suitable concentration, by weight of the spun yarn, including but not limited to 60% or more, 63% or more, 65% or more 70% or more and any concentration between and including the ranges provided.

In one embodiment, the spun yarn described herein comprises: about 55 to 70 weight % meta-aramid fiber; about 7 to 15 weight % nylon fiber; about 5 to 15 weight % para-aramid; about 2 to 5 weight % anti-static fiber, and about 10 to 15 weight % hydrophilic fiber selected from the group consisting of cellulose, cellulose derivative, wool, FR acrylic derivative fiber and combinations thereof. A hydrophilic fiber component of the fiber blend described herein, may comprise any suitable type or combination of hydrophilic fibers including, but not limited to, cellulose, cellulosic derivative fibers, wool, rayon, FR acrylic derivative fibers, or fibers rendered hydrophilic by the addition of a hydrophilic treatment. In one embodiment, a fiber is inherently hydrophilic, whereby it is hydrophilic without the addition of a hydrophilic treatment. A cellulose derivative is cotton, FR Cotton, viscose, linen, lyocell, rayon, fire-resistant rayon, or a combination thereof. The cellulosic derivative fiber component of the spun yarn described herein may comprise any suitable type or combination of cellulosic derivative fibers including, but not limited to, cotton, cellulose, lyocell, cellulose derivatives, and rayon. A cellulosic derivative fiber may be inherently flame resistant, such as wool, or may be treated to render it flame resistant. In addition, a cellulosic derivative fiber may be hydrophobic of hydrophilic and may comprise treatments to render the fiber hydrophobic, hydrophilic or oleophobic.

In an exemplary embodiment, the anti-static fiber component of the spun yarn, described herein, is electrically conductive comprising for example carbon. In one embodiment, an anti-static fiber comprises a carbon fiber with a nylon sheath. Any suitable configuration of fiber may be used to form the anti-static fiber.

The para-aramid fiber component may be a dyed or producer colored, para-aramid. In one embodiment, both the para-aramid and meta-aramid are colored. As described the meta-aramid may be producer colored, or may be printable, whereby it may accept a dye.

The spun yarn, as described herein, may be formed into any suitable type of fabric including, but not limited to, non-wovens, such as hydroentangled, felts, needle-punched, thermal or point bonded, and wet-laid fabrics, and woven fabrics including, plain weaves, twill weaves, denim weaves, and knits for example. The fabrics may be formed into any suitable type of garment, such as pants, shirts, jackets, coveralls, undergarments, hoods, liner materials and the like. In an exemplary embodiment, the spun yarn is plied whereby two yarns are plied providing improved softness, and hand, as well as increased durability and strength over a single ply yarn of the same weight. Any suitable number of yarns may be plied together including, but not limited to, two, three, four, five, more than five and the like. In another exemplary embodiment, an elastomeric filament may be incorporated into a plied yarn, whereby the elastomeric filament is essentially covered, or wrapped by one or more spun yarns around the elastomeric filament. An elastomeric filament may comprise any suitable type of elastomeric material, including Spandex, silicone, fluoroelastomer, polyurethane, FR modified elastic, rubber and the like. A yarn having an elastomer filament may provide two way or four way stretch to a fabric made therefrom.

In some embodiments, the spun yarn, as described herein, is a flame resistant (FR) fiber blend, whereby fabric made therefrom meets NFPA 2112 requirement. Furthermore, the fabric may have an initial wet pick-up of at least 30% and/or a WRR of at least 0.45%/min after 30 wash cycles.

Fabrics made from the spun yarn described herein may have an initial softness that makes it comfortable to wear as received, and may not require repeated washing to reduce stiffness.

Fabrics made from the spun yarn described herein have moisture management properties, or combinations of moisture management properties that demonstrate comfort to a wearer. In addition, fabrics made from the spun yarn described herein may have durable moisture management properties, or performance properties that are not substantially affected by washing. For example, fabrics made from the spun yarn described herein may have any one of the following performance properties or combination of properties: pre-wash vertical wicking of at least about 3.5 cm in 5 minutes; vertical wicking of at least about 3.5 cm in 5 minutes, after 30 washes; pre-wash horizontal wicking of less than about 5 seconds; horizontal wicking of less than about 5 seconds after 30 washes; pre-wash total drying time of less than about 60 minutes; total drying time of less than about 90 minutes after 30 washes; pre-wash comfort zone drying time of less than about 40 minutes; comfort zone drying time of less than about 60 minutes after 30 washes; pre-wash wet pick-up greater than about 30%; wet pick-up greater than about 30% after 30 washes; comfort zone drying time of less than 60 minutes and a vertical wicking height of at least about 3.5 cm after 30 washes; comfort zone drying time of less than 60 minutes and a horizontal wicking time less than about 5 seconds after 30 washes; wet pick-up greater than about 30% and a vertical wicking height of at least 3.5 cm after 30 washes; pre-wash wet pick-up greater than about 30% and a pre-wash horizontal wicking time less than about 5 seconds; wet pick-up greater than about 30% and a horizontal wicking time less than about 5 seconds after 30 washes; pre-wash comfort zone water release rate (WRR) of at least about 0.45 per minute; comfort zone water release rate (WRR) of at least about 0.30% per minute after 30 washes; pre-wash water release rate (WRR) of at least about 0.45 per minute; water release rate (WRR) of at least about 0.35% per minute after 30 washes; pre-wash wet pick-up greater than about 30%, a pre-wash horizontal wicking time less than about 5 seconds and a pre-wash comfort zone water release rate (WRR) of at least about 0.45% per minute; wet pick-up greater than about 30%, and a horizontal wicking time less than about 5 seconds and a comfort zone water release rate (WRR) of at least about 0.30% per minute, after 30 washes.

Fabrics made from the spun yarn described herein have thermal properties, or combinations of thermal properties that demonstrate the thermal protection provided to a wearer of the inventive fabric. Fabric made from the spun yarn described herein provide protection against second and third degree burns having a predicted overall burn of less than 36%, when tested in accordance with the American Society for Testing and Materials Standard Test ASTM F 1930-2000. In an exemplary embodiment, fabrics made from the spun yarn described herein have any one of the following thermal performance properties or combination of thermal properties: char length less than about 4.0 inches, when tested in accordance with the American Society for Testing and Materials Standard Test ASTM 6413; heat and thermal shrinkage resistance value of less than about 8%, when tested in accordance with the National Fire Prevention Association NFPA 1971 and a thermal protective performance value of at least about 5, when tested in accordance with the National Fire Prevention Association NFPA 1971 (without spacer); and having a heat and thermal shrinkage resistance value of less than about 5% when tested in accordance with NFPA 2112 and a thermal protective performance value of at least about 5, when tested in accordance with the National Fire Prevention Association NFPA 1971 (without spacer).

In an exemplary embodiment, a fabric made from the spun yarn described herein has a wet abrasion of at least 3000, that in some cases is at least equal to or greater than a corresponding dry tear value when tested in accordance with the American Society for Testing and Materials Standard Test ASTM D 1424 (condition 1 dry; condition 2 wet).

As shown in FIG. 1, an exemplary concentration of a fiber blends is provided in a pie chart. The meta-aramid of fiber blend one is a producer colored. The 15% cellulosic derivative component is shown displaced from the rest of the pie chart, and is the only hydrophilic component in this embodiment. Therefore, the fiber blend shown in FIG. 1 is comprised of 85% hydrophobic fiber component and 15% hydrophilic fiber component. The fiber blend shown in FIG. 1 comprises 70% aramid fiber, having 60% meta-aramid and 10% para-aramid. Example fabric 1 and 2, as described later herein, comprise the fiber blend described in FIG. 1.

Figure 2:
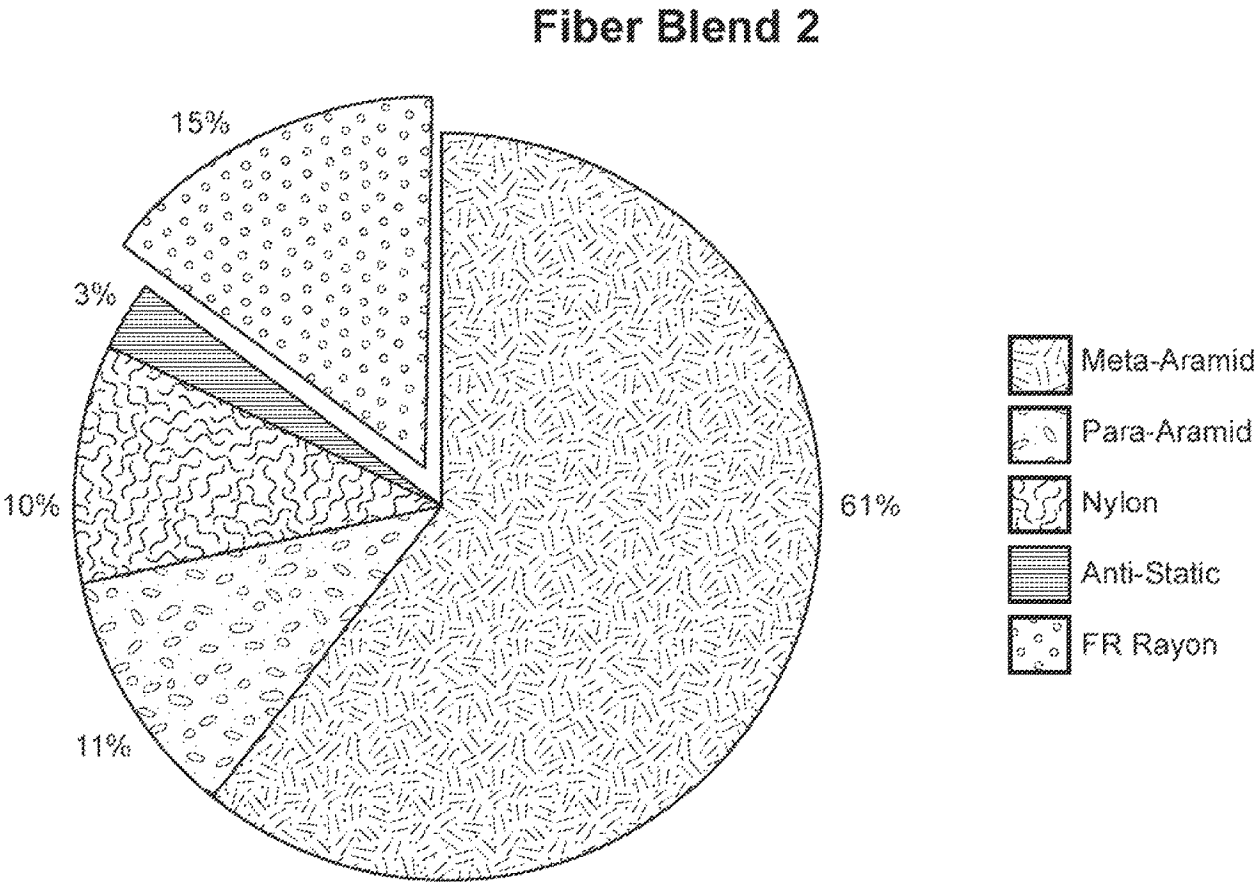
FIG. 2 is a pie graph showing the fiber blend concentrations of Fiber Blend 2, an exemplary embodiment described herein.

As shown in FIG. 2, an exemplary concentration of the fiber blends is provided in a pie chart. The meta-aramid of fiber blend 2 is printable, or dye accepting and/or can be printed thereon. Again, the 15% cellulosic derivative component is shown displaced from the rest of the pie chart, and is the only hydrophilic component in this embodiment. The fiber blend shown in FIG. 2 comprises more than 70% aramid fiber, having 61% meta-aramid and 10% para-aramid Example fabric 3, as described later herein, comprises the fiber blend described in FIG. 2.

The fiber blends, as described herein, and fabrics made therefrom have excellent moisture management properties as shown in FIG. 3 and FIG. 4. All of the fabrics shown in FIG. 3 and FIG. 4 were plain weaves and all had approximately the same weight, between 4.6 and 7.0 oz/yd$^2$. FIG. 3 is a chart of pre-wash moisture management related test data including, wet pick-up or water weight gain, horizontal wicking, vertical wicking, total and comfort zone dry time, and water release rate (WRR). Fabric examples 1-3, of the present invention had high wet pick-up values, which were reached in less than 10 seconds as opposed to the comparative fabrics that had to be submerged for 10 minutes before absorbing the much lower amount of water. Fabric examples 1-3, had pre-wash wet pick-up values of above 25% and some samples had wet-pick up values greater than 30%. Fabric example 1-3 all had wet pick-up values of above 30% after 30 washes. A high wet pick-up value indicates that the fabric has the capability to wick a substantial amount of water/sweat away from a wearer, the speed at which it absorbs also reflects the ability to move moisture/sweat off the skin and into the fabric. The wet pick-up values for the comparative fabrics were obtained by submerging the comparative fabrics in water in order to wet them. Comparative examples 1 and 2 had very low pre-wash wet pick-up values of less than 5%. In addition, Fabric examples 1-3 all had a horizontal wicking time of less than 5 seconds. In contrast, some of the comparative fabrics all had a horizontal wicking time of more than 100 seconds indicating that these samples where hydrophobic. Comparative fabric 3 had a horizontal wicking of 3 seconds before wash and 42 after 25 washes which demonstrates this fabric's inconsistencies in moving moisture away from body over the life of the material. A low horizontal wicking time indicates that water will spread out quickly over the surface of the fabric. This is desirable, as it allows for quicker distribution and evaporation of sweat from the fabric. The comparative fabrics would not effectively wick water away from a wearer. Fabric examples 1-3 had a unique combination of low horizontal wicking times, less than 5 seconds, and high WRR rates, greater than about 0.5%/min.

FIG. 4 provides moisture management properties for fabric samples that were washed thirty times. Fabric Examples 1-2 had very low horizontal wicking times of five seconds or less. Comparative fabrics 1-2 had a horizontal wicking time of 100+ in both the zero wash test and after 30 washes; indicating that water did not spread out or wick over the surface of the samples. Comparative example 3 had a prewash horizontal wicking time of 3 seconds and a 42 second horizontal wicking time after 30 washes, indicating that the fabric became less hydrophilic with repeated washing and is therefore not durable. Fabric Examples 1-3 all had high vertical wicking lengths of more than 5 cm for both pre-wash and 30 wash samples. A high vertical wicking height indicates that water will be wicked through a fabric and may be affected by the fiber types, yarn construction and fabric construction. Comparative fabrics 1 and 2 had very low vertical wicking heights indicating that water will not wick through the fabric. Fabric Examples 1 and 2 where the only samples that maintained a combination of low horizontal wicking times and high vertical wicking lengths, and thereby may be considered to have durable moisture management properties. Example 3 was a printed fabric and would also have demonstrated this combination of properties, and did so in a pre-printed form, but had been coated with hydrophobic inks, pigments and binders during the camouflage printing process which can impact the natural wicking process.

In certain embodiments, the fiber blends described herein, and fabrics made therefrom, are flame resistant (FR), meeting the requirements of NFPA 2112. As shown in FIGS. 5-7, fabrics made with fiber blends as described herein had low after flame times, after glow times, and char length, both as received and after five launderings. The char lengths for all three fabric examples were less than 3.6 in. The laundering was performed according to FTM 191-5556.

All three of the fabric examples as described herein were characterized using the PyroMan system by the Textile Protection and Comfort Center (T-PACC) at North Carolina State University. As shown in FIG. 8, all three fabric examples had an average overall predicted burn of less than 36%. In addition, the average predicted third degree burn was very low, at less than 8.5% for all three fabric examples.

Fabric example 3 was tested for Thermal Protective Performance (TPP) under National Fire Prevention Association NFPA 1971 both unwashed and after five washes by SFI Test Laboratory, Poway, Calif. In addition, tests were performed with and without a spacer as shown in Table 1. In all cases fabric example 3 had an average TPP greater than 7.5 cal/cm$^2$ min, and when a quarter inch spacer was used, the average TPP was greater than 12 cal/cm$^2$ min for both the unwashed and washed samples.

TABLE 1

| Condition | Spacer | Approx. Weight (oz/sq. yd) | Thickness (mils) | Test 1 | Test 2 | Test 3 | Avg. TPP |
|---|---|---|---|---|---|---|---|
| Unwashed | ¼" | 5.62 | 18 | 12.1 | 12.7 | 12.4 | 12.4 |
| Unwashed | None | 5.6 | 18 | 7.6 | 7.5 | 7.6 | 7.5 |
| Washed | ¼" | 6.2 | 28 | 13.8 | 13.9 | 13.9 | 13.8 |
| Washed | None | 6.3 | 28 | 8.5 | 8.4 | 8.5 | 8.4 |

FIG. 9 provides dimensional stability data as well as abrasion resistance data for fabric examples described herein and comparative examples. The fabric examples described herein had high dimension stability with only 2.5% shrinkage when tested according to AATCC 135. In addition, the fabric examples had significantly higher dry and wet abrasion resistance with two of the examples having a dry abrasion of 7000. All three of the fabric examples had a wet abrasion of 3000 or more, twice that of the comparative examples.

Fabric Example 3 was tested for thermal shrinkage or Convective Heat Resistance ISO 17493 by TexTest, Phenix City, Ala. An as received sample and a sample washed five times, according to AATCC 135 II, Aii, were subject to 500° C. for 5 minutes. The percentage shrinkage for both samples is reported for both the length and width direction in Table 2. The as received and wash sample had a percent shrinkage of less than 5.5%. Both sample passed the requirements of NFPA 1971 Heat and Thermal Shrinkage Resistance Test as received and after five washes.

TABLE 2

| | As Received | | 5 Washes | |
|---|---|---|---|---|
| | Length | Width | Length | Width |
| Shrinkage % | 5.4 | 4.9 | 4.6 | 3.5 |

Two samples of fabric example 3 were submitted for Electrostatic Decay testing to FTMS 191, Method 5931. The as received sample was as manufactured and had not been washed and the washed sample had been washed five times. Three test samples were cut out from the fabric samples. The samples were then conditioned at 10% R.H. and 73° F. overnight, and then for 24 hours at 20% R.H. and 73° F. prior to testing. Testing was completed using the test methods described in FTMS 191-Method 5931 and the results are provided in Table 3.

TABLE 3

| Electrostatic Decay Time As Received Samples | | | | Electrostatic Decay Time - Washed Samples | | | |
|---|---|---|---|---|---|---|---|
| | | Decay Time (seconds) | | | | Decay Time (seconds) | |
| Sample # | Direction | Face | Opposite | Sample # | Direction | Face | Opposite |
| 1 | 1 | 0.03 | 0.01 | 1 | 1 | 0.01 | 0.01 |
| 2 | 1 | 0.01 | 0 | 2 | 1 | 0.01 | 0 |
| 3 | 1 | 0.02 | 0.01 | 3 | 1 | 0.01 | 0.01 |
| 4 | 2 | 0.01 | 0.02 | 4 | 2 | 0.02 | 0.01 |
| 5 | 2 | 0.03 | 0.02 | 5 | 2 | 0.01 | 0 |
| 6 | 2 | 0.04 | 0.03 | 6 | 2 | 0 | 0.01 |

FTMS 191-Method 5931 has a requirement that the decay time be less than 0.5 seconds. The fabric met the requirement with nearly instantaneous decay time.

Fabric example 1 and 2 were evaluated for color fastness and pilling using the Procedure for Appearance of Apparel and Other Textile End Products After Repeated Home Laundering, AATCC/ASTM TS-008, by Manufacturing Solution Center, Hickory, N.C. The samples were laundered following AATCC 135 with alternating washing and drying conditions. Photographic standards were used to rate the degree of pilling of samples after wash cycles. A grade of five indicates excellent pilling resistance and a grade of one indicates a very poor pilling resistance. Likewise a color loss rating of five indicates essentially no color loss and a color loss rating of one indicates dramatic fading of the color. Results are provided in Table 4.

TABLE 4

| | Example 1 | | Example 2 | |
|---|---|---|---|---|
| | Color Loss | Pilling | Color Loss | Pilling |
| After 5 Washes | 5.0 | 5.0 | 5.0 | 5.0 |
| After 10 Washes | 4.5 | 5.0 | 4.5 | 5.0 |
| After 15 Washes | 4.5 | 4.5 | 4.5 | 4.5 |
| After 20 Washes | 4.0 | 4.5 | 4.5 | 4.5 |
| After 40 Washes | 4.0 | 4.5 | 4.5 | 4.5 |
| After 50 Washes | 4.0 | 4.0 | 4.0 | 4.5 |

The three fabric examples as described herein were tested for air permeability according to FTM 191-5450 using a Frazier 2000 that measures cubic feet of air that passes through one square foot of sample at a half inch water pressure drop. All three samples had a frazier value of greater than 25 and two of the fabrics had frazier values greater than 40. This high air permeability may contribute to the fabric being more comfortable to wear, especially in hot work environments. Results are provided in Table 5.

TABLE 5

| Fabric | | Specimen Results | | | | | Average |
|---|---|---|---|---|---|---|---|
| Example 1 | 1st Side | 57 | 51 | 51 | 45 | 50 | 49 |
| | 2nd Side | 43 | 46 | 47 | 46 | 52 | |
| Example 2 | 1st Side | 30 | 27 | 29 | 27 | 26 | 28 |
| | 2nd Side | 28 | 30 | 31 | 27 | 27 | |
| Example 3 | 1st Side | 50 | 42 | 36 | 47 | 38 | 42 |
| | 2nd Side | 39 | 39 | 41 | 48 | 41 | |

The three fabric examples as described herein were tested for break strength according to FTM 191-5100. All three samples had a break strength greater than 120 lbs in both the warp and fill directions as shown in Table 6.

TABLE 6

| | | Specimen Results (lbs) | | | | | | | | Average lbs |
|---|---|---|---|---|---|---|---|---|---|---|
| Example 1 | Warp | 150 | 154 | 156 | 159 | 159 | | | | 156 |
| Example 1 | Fill | 121 | 122 | 122 | 128 | 128 | 121 | 122 | 126 | 124 |
| Example 2 | Warp | 173 | 180 | 177 | 164 | 168 | | | | 172 |
| Example 2 | Fill | 124 | 130 | 132 | 130 | 124 | 130 | 129 | 137 | 130 |
| Example 3 | Warp | 172 | 177 | 197 | 174 | 178 | | | | 179 |
| Example 3 | Fill | 130 | 130 | 132 | 133 | 131 | | | | 131 |

In another aspect, the invention is directed to yarns comprising the various fiber blends described herein, wherein said fibers are intimately blended. An intimate fiber blend may be formed into any suitable fabric, as described herein. In an exemplary embodiment, an intimate blend of fibers is formed into a woven fabric. In another exemplary embodiment an intimate blend of fibers is formed into a knit fabric.

In another aspect, the invention is directed to fabrics formed from the yarns comprising the various blends described herein. The fabrics may be either woven or knitted. In certain embodiments, the fabric has a basis weight of less than about 8.0 ounces/square yard (OPSY). In certain other embodiments, the fabric has a basis weight of less than about 6.0 ounces/square yard (OPSY).

Figure 10:
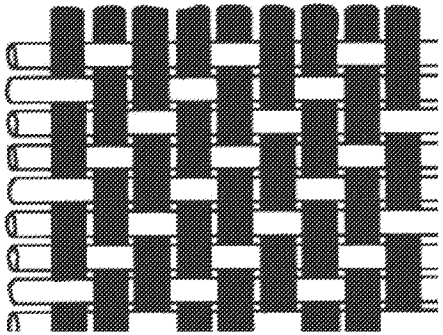
FIG. 10 is a top view of woven fabric in a 2×1 twill weave.
Figure 11:
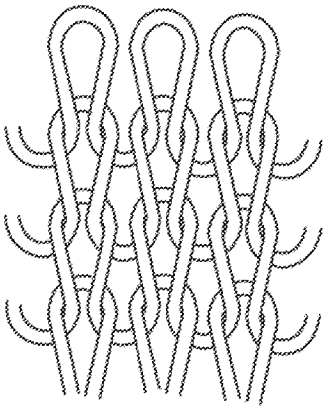
FIG. 11 is a top down view of a knit having looped yarns.

The spun yarn as described herein may formed into any suitable type of fabric in including, but not limited to, non-wovens, such as hydroentangled, needle-punched, and wet-laid, and wovens including, twill weaves, rip-stop, plain weaves, denim weaves, and knits for example. In one embodiment, the fiber blend described herein may be formed into a knit fabric. As shown in FIG. 11, a fabric having a knit weave typically has more open area than a twill type weave, as shown in FIG. 11. A knit fabric comprises looped yarns that provide a comfortable feel, however, this type of weave may be more susceptible to high thermal shrinkage. Tighter weaves, such as that shown in FIG. 10, however comprise yarns that are more tightly packed and therefore typically perform better in thermal shrinkage tests, than knits. In some embodiments, a fabric made from the spun yarn described herein may be formed into a garment. In certain embodiments, the fabric forms at least one outer portion of the garment because of the protection it provides. A fabric made with the spun yarn described herein may be useful in garments such as outwear, including, but not limited to coats, coveralls, overalls, shirts, and pants, and may be particularly useful in firefighter turnout coats, combat and flight suits. In other embodiments, a fabric may be formed into a garment, such as an undershirt, in a single tubular design to reduce the number of seams.

In certain embodiments, a fabric made with the spun yarn described herein may have a heat and a thermal protective performance value of at least about 5 cal/cm$^2$ min, preferably at least about 5.7 cal/cm$^2$ min initially, and at least about 6.7 cal/cm$^2$ min after 3 washing cycles, when tested in accordance with the National Fire Prevention Association NFPA 1971 (without spacer), as provided herein.

The present invention is further defined in the following Examples, in which all parts and percentages are by weight, unless otherwise stated. It should be understood that these examples, while indicating preferred embodiments of the invention, are given by way of illustration only. From the above discussion and these examples, one skilled in the art can ascertain the essential characteristics of this invention, and without departing from the spirit and scope thereof, can make various changes and modifications of the invention to adapt it to various usages and conditions.

EXAMPLES

Fabrics were produced in two blends as described in Table 7. Producer colored meta-aramid fiber was used for solid shades and consisted of a ratio of 60% Nomex type meta-aramid, 15% Rayon, 13% Nylon, 10% para aramid and 2% anti-static fiber. Undyed meta-aramid fibers were used for printed fabrics in a ratio of 61% Nomex, 15% Rayon, 11% Nylon, 10% para aramid and 3% anti-static fiber. Fibers were blended into a homogenous mix and then processed through carding, drawing and roving. Yarn was formed on ring spinning equipment to the specified counts preferably in the range from 20/1 to 40/1. Alternative staple fiber spinning technologies that could be used include air jet spinning, compact spinning, ring and SIRO spinning, DREF spinning and Open End spinning. Yarn was then plied to yield plied counts between 20/2 and 40/2 or an effective 10 to 20 Ne. Fabric was then woven into a plain weave construction with a 66 warp by 48 weft count. In addition, fabric was also woven into fabric having a twill weave and with a 68 warp by 50 weft count. Alternative embodiments may be knit and nonwoven fabrics as well as other woven constructions.

For solid shades, the fabrics were scoured according to standard industry practices and the Rayon and Nylon fibers were vat dyed to match the producer dyed shade. Performance finishes may be applied at this point including antimicrobial, permanent press, stain resistance, insect repellent, or durable water repellant. The printed fabric was also scoured according to standard industry practices, pigment tinted and printed in a military camouflage pattern. The fabric was then sanforized. Performance finishes may be applied during the printing finishing process and may include antimicrobial, permanent press, stain resistance or durable water repellant.

TABLE 7

| Fabric Examples: | | | |
|---|---|---|---|
| Fabric | Fiber Content | Type | Weight 0z/Sq. Yd. |
| Fabric Example 1 | 60% Nomex/15% FRRayon/ 13% Nylon/10% Para-aramid/ 2% Anti-stat | Producer Dyed | 5.0 |
| Fabric Example 2 | | Producer Dyed | 5.5 |
| Fabric Example 3 | 61% Nomex/15% FRRayon/ 11% Nylon/10% Para-aramid/ 3% Anti-stat | Printed Fabric | 5.5 |

Comparative Fabric Examples

Comparative fabrics were sourced from the producers as listed in Table 8 below. The fiber content of the comparative fabrics is provided. The comparative fabrics chosen have high aramid content and are also fiber blends.

TABLE 8

| Fabric | Fiber Content | Producer | Weight 0z/Sq. Yd. |
|---|---|---|---|
| Comparative 1 | 92% Meta-aramid/5% Para-aramid/3% Conductive Fibers | Propper International Inc. | 4.6 |
| Comparative 2 | 95% Meta-aramid/5% Para-aramid | Not available | 5.8 |
| Comparative 3 | 92% Meta-aramid/5% Para-aramid/3% Conductive Fibers | Milliken & Company | 6.9 |

Test Methods

The following test methods were used to evaluate exemplary embodiments and comparative materials, unless otherwise noted.

Water Weight Gain and Water Release Rate (WRR) Test Method

The water release rate (WRR) of materials made according to the present invention as well as comparative materials were measured according to AATCC MM TS-05A.

Gravimetric Drying Test Method (WRR, Drying Time and Wet Pick-Up)

The drying times of materials made according to the present invention as well as comparative materials were measured according to AATCC MM TS-05A.

For a typical test, four 2.5×2.5 inch square samples were used. Two of the samples were the "control" (reference) fabric and two were the "test" fabric of interest. Samples were conditioned in the conditioning room at temperature of 70° F. and 65% relative humidity for at least 4 hours prior to test. The samples were then weighed using a laboratory balance, accurate to 0.0001 g to establish the conditioned dry weight. Then 10 mL of distilled water was placed into a 25 ml beaker. Samples were submerged, one sample in the beaker for five to ten minutes, making certain that the sample was completely submerged under the water to insure complete wetting. Even samples exhibiting poor or no horizontal wicking, such as 100 seconds or more horizontal wicking time, absorb water if submerged as described. Samples were then removed from the beaker and sandwiched between two pieces of unused AATCC blotter paper and passed through a wringer (LabPro Padder). The samples were then left sandwiched in the wet blotters until removed and affixed to the vertical samples stand. A vertical sample stand comprising a wire loop supported by a foam base, wherein the top of the wire loop was approximately 15 cm above the top of the base and the parallel wire portions extending from the base were approximately 7.5 cm apart, was used for supporting the samples during drying. The vertical sample stand, and clips were placed on the balance and the balance was tared. The blotted wet sample was attached to the top of the wire loop using the clips, such that the sample hung down within the wire loop. The weight of the sample was recorded to establish a wet weight. The difference in the wet weight and the conditioned dry weight was the recorded and is provided in FIG. 3 and FIG. 4 as the Wet Pick-Up value. The balance was coupled to a data acquisition system comprising Lab View software. Weight readings were automatically recorded every 15 seconds by the computer. The test was complete once the sample weight had reached a designated stopping moisture level versus the conditioned dry weight. The stopping moisture level was approximately 0.5% to 1%. The test was ended by stopping data acquisition in Lab View. The data file was saved for that sample.

Calculation and Interpretation

Total drying time is the time it takes the specimen to reach the stopping weight.

Total water release rate ("WRR", g/min) was calculated as follows:

Total WRR=(wet specimen weight−ending specimen weight)/(total drying time)

WRR, total (%) is calculated from the respective total WRR values as follows:

$$WRR_{total}=100\times(WRR_{test}-WRR_{control})/WRR_{control}$$

"Comfort Zone" drying time (min) is the time it takes the specimen's moisture content to decrease from 20% to approximately 1%.

"Comfort Zone" WRR (g/min) was calculated as follows:

Active WRR=(wet specimen weight−ending specimen weight)/("active" drying time)

WRR(Comfort Zone) was calculated in the same manner as for WRR(total) except using test and control WRR (Comfort Zone) values.

Horizontal Wicking

The horizontal wicking time of materials made according to the present invention as well as comparative materials were measured according to AATCC 79, Absorbency of Textiles.

Vertical Wicking (AATCC MM TS-06 Vertical Wicking-Modified-Hanes Protocol)

The purpose of this test is to determine the rate at which water will wick vertically up test specimens suspended in water. A flat dish capable of holding 500 ml of distilled water was filled with 200 ml of water. Samples of fabric approximately 10 cm in length (warp) and width (weft) direction were cut for evaluation. A paper clip was attached to the bottom of the sample to ensure submerging the lower end of the sample. A top end was attached with a binding clip to a horizontal bar making sure the bottom paper clip will be submerged into the water. The sample was lowered into the dish and timed in minutes until the water traveled up the sample to a height of 2 cm. Also after 3 and 5 minutes the distance traveled by the water was noted as vertical wicking length. Final wicking length was the average of warp and weft wicking length after 5 minutes.

Dry & Wet Abrasion Resistance (ASTM D 4966):

Test Method followed was Modified ASTM D 4966—Abrasion Resistance of Textile Fabrics (Martindale Abrasion Tester Method) 2. Abradant used was 600 ultrafine grit 3M (9084NA) sandpaper and the fabric was subject to 9 kPa of pressure. For the wet abrasion test, fabrics were soaked in water and passed through the padding mangle at 0.05 MPa pressure. A Laboratory Dye Padder available from Lab-Pro, Dorfstrasse 19 Germany, was used for the padding to remove excess water from the samples.

Heat and Thermal Shrinkage Resistance NFPA 2112-0.7 Ed, Section 8.4

This test determines the performance of fabrics when exposed to heat in an oven at 500° F. Observations of ignition, melting, dripping, or separation are recorded and reported for each specimen. The percent change in the width and length direction of the specimen is calculated. Results are recorded and reported as the average of three specimens.

Specimen marking and measurements are conducted in accordance with the procedure specified in AATCC 135 Dimensional Change in Automatic Home Laundering of Fabrics. The specimen is suspended by metal hooks at the top and centered in an oven so that the entire specimen is not less than 50 mm from any oven surface or other specimen, and air is parallel to the plane of the material. The specimen, mounted as specified, was exposed in the test oven for 5 minutes at 500° F.

Flame Resistance of Textiles (Vertical)

This test method determines the response of textiles to a standard ignition source, deriving measurement values for after-flame time, afterglow time, and char length. The vertical flame resistance, as determined by this test method, only relates to a specified flame exposure and application time. This test method maintains the specimen in a static, draft-free, vertical position and does not involve movement except that resulting from the exposure. Test Method D6413 has been adopted from Federal Test Standard No. 191A method 5903.1, which has been used for many years in acceptance testing.

Samples were cut from fabric to be tested and were mounted in a frame that was hung vertically from inside the flame chamber. A controlled flame was exposed to the sample for a specified period of time. After-flame time, the length of time the material continued to burn after removal of the burner, and after-glow time, the length of time the material glowed after the flame was extinguished, were both recorded. Finally, the specimen was torn by use of weights and the char length, the distance from the edge of the fabric that was exposed to the flame to the end of the area affected by the flame, was measured.

Characterization of Test Garments Using PyroMan System

Multiple ensembles were submitted for evaluation. Garments were evaluated for resistance to a simulated flash fire exposure employing procedures similar to ASTM F 1930-00 Standard Test Method for Evaluation of Flame Resistant Clothing for Protection Against Flash Fire Simulations Using an Instrumented Manikin. These tests were performed by the Textile Protection and Comfort Center (T-PACC) at North Carolina State University.

Flash Fire Test Results: Manikin Test

ASTM F1930-99 is a full-scale mannequin test designed to test fabrics in completed garment form in a simulated flash fire. A mannequin, with up to 122 heat sensors spaced around its body, is dressed in the test garment, and then exposed to a flash fire for a pre-determined length of time. Tests are usually conducted at heat energies of 1.8-2 cal/cm$^2$ sec, and for durations of 2.5 to 5.0 seconds for single layer garments. Results are reported in percentage of body burn. For consistency in data and accuracy of comparison, the test method defines a standard garment size and configuration that must be used on each test. Test garments were tested over a 100% cotton T-Shirt and briefs per NFPA 2112 Standard on Flame-Resistant Garments for Protection of Industrial Personnel Against Flash Fire.

Arc Rating: ASTM F 1959/F 1959M-06Ael—Standard Test Method for Determining the Arc Rating of Materials for Clothing This test method was used to measure the arc rating of materials intended for use as flame resistant clothing for workers exposed to electric arcs that would generate heat flux rates from 84 to 120 kW/m2 (2 to 600 cal/cm2 s). This test method will measure the arc rating of materials which meet the following requirements: less than 150 mm [6 in.] char length and less than 2 s after flame when tested in accordance with Test Method D 6413A.

Electrostatic Decay of Fabric Per FTMS 191-Method 5931

FTMS 191-Method 5931 has a requirement that the decay time be less than 0.5 seconds. The fabric met the requirement with nearly instantaneous decay times.

Those skilled in the art will appreciate that numerous changes and modifications can be made to the preferred embodiments of the invention and that such changes and modifications can be made without departing from the spirit of the invention. It is, therefore intended that the appended claims cover all such equivalent variations as fall within the true spirit and scope of the invention.

What is claimed is:

1. A spun yarn comprising:

about 60 to 80 weight %, based on the total weight of the spun yarn, meta-aramid fiber;

about 7 to 15 weight %, based on the total weight of the spun yarn, nylon fiber;

about 5 to 15 weight %, based on the total weight of the spun yarn, para-aramid;

about 2 to 5 weight %, based on the total weight of the spun yarn, anti-static fiber, and about 10 to 15 weight %, based on the total weight of the spun yarn, hydrophilic fiber;

wherein said hydrophilic fiber is selected from the group consisting of cellulose, cellulose derivatives, wool, and combinations thereof;

wherein said fibers are intimately blended; and wherein, when said spun yarn is formed into a fabric, said fabric is flame resistant (FR), meeting the ASTM F1930 requirements of NFPA 2112.

2. A spun yarn of claim 1, wherein said meta-aramid fiber is present at a level of more than 62% by weight, based on the total weight of the spun yarn; and wherein said hydrophilic fiber is wool or fire-resistant rayon.

3. A spun yarn of claim 1, wherein said nylon fiber is present at a level of about 10% to 12% by weight, based on the total weight of the spun yarn.

4. A spun yarn of claim 1, wherein said para-aramid fiber is present at a level of about 10% to 12% by weight, based on the total weight of the spun yarn.

5. A spun yarn of claim 1, wherein said anti-static fiber is present at a level of about 2.5% to 3.5% by weight, based on the total weight of the spun yarn.

6. A spun yarn of claim 1, wherein said hydrophilic fiber is present at a level of about 12% to 15% by weight, based on the total weight of the spun yarn.

7. A spun yarn of claim 1,
wherein said spun yarn comprises about 85 to 90 weight %, based on the total weight of the spun yarn, hydrophobic component, and about 10 to 15 weight %, based on the total weight of the spun yarn, hydrophilic component.

8. A spun yarn of claim 7,
wherein the hydrophobic component consists essentially of:
about 60 to 80 weight %, based on the total weight of the spun yarn, meta-aramid fiber;
about 7 to 15 weight %, based on the total weight of the spun yarn, nylon fiber;
about 5 to 15 weight %, based on the total weight of the spun yarn, para-aramid; and
about 2 to 5 weight %, based on the total weight of the spun yarn, anti-static fiber.

9. A spun yarn of claim 1, consisting essentially of:
about 60 to 80 weight %, based on the total weight of the spun yarn, meta-aramid fiber;
about 7 to 15 weight %, based on the total weight of the spun yarn, nylon fiber;
about 5 to 15 weight %, based on the total weight of the spun yarn, para-aramid;
about 2 to 5 weight %, based on the total weight of the spun yarn, anti-static fiber; and
about 10 to 15 weight %, based on the total weight of the spun yarn, hydrophilic fiber;
wherein said hydrophilic fiber is selected from the group consisting of cellulose, cellulose derivatives, wool, and combinations thereof.

10. A spun yarn of claim 1, comprising:
about 60 to 70 weight %, based on the total weight of the spun yarn, meta-aramid fiber;
about 7 to 15 weight %, based on the total weight of the spun yarn, nylon fiber;
about 5 to 15 weight %, based on the total weight of the spun yarn, para-aramid;
about 2 to 5 weight %, based on the total weight of the spun yarn, anti-static fiber; and
about 10 to 15 weight %, based on the total weight of the spun yarn, hydrophilic fiber selected from the group consisting of cellulose, cellulose derivative, wool, and combinations thereof.

11. A spun yarn of claim 1, consisting essentially of:
more than 62 weight %, based on the total weight of the spun yarn, meta-aramid fiber;
about 7 to 15 weight %, based on the total weight of the spun yarn, nylon fiber;
about 5 to 15 weight %, based on the total weight of the spun yarn, para-aramid;
about 2 to 5 weight %, based on the total weight of the spun yarn, anti-static fiber, and
about 10 to 15 weight %, based on the total weight of the spun yarn, hydrophilic fiber;
wherein said hydrophilic fiber is selected from the group consisting of cellulose, cellulose derivatives, wool, and combinations thereof; and
wherein said fibers are intimately blended.

12. A spun yarn of claim 1,
wherein said meta-aramid fiber is printable.

13. A spun yarn of claim 1,
wherein said meta-aramid fiber is producer colored.

14. A spun yarn of claim 1,
wherein said hydrophilic fiber is flame resistant.

15. A spun yarn of claim 1,
wherein said cellulose derivative is cotton, viscose, linen, rayon, fire-resistant rayon, or a combination thereof.

16. A spun yarn of claim 1,
wherein more than 85 weight % of said fibers are flame resistant.

17. A spun yarn of claim 1,
wherein said anti-static fiber comprises a conductive fiber.

18. A spun yarn of claim 1,
wherein the anti-static fiber comprises a carbon fiber with a nylon sheath.

19. A spun yarn of claim 1,
wherein said para-aramid fiber is producer colored para-aramid.

20. A spun yarn of claim 1, further comprising an elastomeric filament.

21. A spun yarn of claim 1,
wherein the spun yarn is configured into a plied yarn having counts between 20/2 and 40/2 or an effective 10 to 20 Ne.

22. A spun yarn, consisting of:
more than 62 weight %, based on the total weight of the spun yarn, meta-aramid fiber;
about 7 to 15 weight %, based on the total weight of the spun yarn, nylon fiber;
about 5 to 15 weight %, based on the total weight of the spun yarn, para-aramid;
about 2 to 5 weight %, based on the total weight of the spun yarn, anti-static fiber, and
about 10 to 15 weight %, based on the total weight of the spun yarn, hydrophilic fiber;
wherein said hydrophilic fiber is selected from the group consisting of cellulose, cellulose derivatives, wool, and combinations thereof;
wherein said fibers are intimately blended.

23. A fabric, comprising said spun yarn of claim 1.

24. A fabric of claim 23,
wherein said fabric has a pre-wash vertical wicking of at least about 3.5 cm in 5 minutes.

25. A fabric of claim 23,
wherein said fabric has a vertical wicking of at least about 3.5 cm in five minutes, after 30 washes.

26. A fabric of claim 23,
wherein said fabric has a vertical wicking durability of at least 0.60.

27. A fabric of claim 23,
wherein said fabric has a pre-wash horizontal wicking of less than about 5 seconds.

28. A fabric of claim 23,
wherein said fabric has a horizontal wicking of less than about 5 seconds after 30 washes.

29. A fabric of claim 23,
wherein said fabric has a pre-wash total drying time of less than about 60 minutes.

30. A fabric of claim 23,
wherein said fabric has a total drying time of less than about 90 minutes after 30 washes.

31. A fabric of claim 23,
wherein said fabric has a pre-wash comfort zone drying time of less than about 40 minutes.

32. A fabric of claim 23,
wherein said fabric has a comfort zone drying time of less than about 60 minutes after 30 washes.

33. A fabric of claim 23,
wherein said fabric has a pre-wash wet pick-up greater than about 30%.

34. A fabric of claim 23,
wherein said fabric has a wet pick-up greater than about 30% after 30 washes.

35. A fabric of claim 23,
wherein said fabric has a comfort zone drying time of less than 60 minutes and a vertical wicking height of at least about 3.5 cm in five minutes, after 30 washes.

36. A fabric of claim 23,
wherein said fabric has a wet pick-up greater than about 30% and a vertical wicking height of at least 3.5 cm in five minutes, after 30 washes.

37. A fabric of claim 23,
wherein said fabric has a pre-wash wet pick-up greater than about 30% and a pre-wash horizontal wicking time less than about 5 seconds.

38. A fabric of claim 23,
wherein said fabric has a wet pick-up greater than about 30% and a horizontal wicking time less than about 5 seconds after 30 washes.

39. A fabric of claim 23,
wherein said fabric has a pre-wash comfort zone water release rate (WRR) of at least about 0.45% per minute.

40. A fabric of claim 23,
wherein said fabric has a comfort zone water release rate (WRR) of at least about 0.30% per minute after 30 washes.

41. A fabric of claim 23,
wherein said fabric has pre-wash wet pick-up greater than about 30%, a pre-wash horizontal wicking time less than about 5 seconds and a pre-wash comfort zone water release rate (WRR) of at least about 0.45% per minute.

42. A fabric of claim 23,
wherein said fabric has wet pick-up greater than about 30%, a horizontal wicking time less than about 5 seconds and a comfort zone water release rate (WRR) of at least about 0.30% per minute, after 30 washes.

43. A fabric of claim 23,
wherein said fabric provides protection against second and third degree burns on less than about 35% of the wearer, when tested in accordance with the American Society for Testing and Materials Standard Test ASTM F 1930-2000.

44. A fabric of claim 23,
wherein said fabric has a char length less than about 4.5 inches, when tested in accordance with the American Society for Testing and Materials Standard Test ASTM 6413.

45. A fabric of claim 23,
wherein said fabric has a heat and thermal shrinkage resistance value of less than about 8%, when tested in accordance with the National Fire Prevention Association NFPA 1971 and a thermal protective performance value of at least about 5, when tested in accordance with the National Fire Prevention Association NFPA 1971 (without spacer).

46. A fabric of claim 23,
wherein said fabric has wet abrasion of at least 3000 cycles.

47. A fabric of claim 23,
wherein said fabric has a wet tear value of at least equal to or greater than a corresponding dry tear value, when tested in accordance with the American Society for Testing and Materials Standard Test ASTM D 1424 (condition 1 dry; condition 2 wet).

48. A fabric of claim 23,
wherein the fabric spun yarn further comprises an elastomeric filament.

49. A fabric of claim 48,
wherein the fabric is a two way stretch fabric.

50. An article, comprising the fabric of claim 23.

* * * * *